United States Patent [19]

Zebuhr

[11] 4,043,388

[45] Aug. 23, 1977

[54] THERMAL TRANSFER CARE

[75] Inventor: William Henry Zebuhr, Nashua, N.H.

[73] Assignee: Deschamps Laboratories, Inc., East Hanover, N.J.

[21] Appl. No.: 605,654

[22] Filed: Aug. 18, 1975

[30] Foreign Application Priority Data

Aug. 14, 1975 Canada ..... 224,549

[51] Int. Cl.[2] ..... F28F 3/02

[52] U.S. Cl. ..... 165/166

[58] Field of Search ..... 165/157, 166, 7, 170; 62/291

[56] References Cited

U.S. PATENT DOCUMENTS

| | | | |
|---|---|---|---|
| 213,635 | 3/1979 | Drache | 165/166 |
| 785,580 | 3/1905 | Shiels et al. | 165/167 |
| 2,281,154 | 4/1942 | Hromadko | 165/166 |
| 2,526,157 | 10/1950 | Ramen | 165/166 |
| 2,596,008 | 5/1952 | Collins | 165/157 |
| 2,889,692 | 6/1959 | McGrew | 62/291 |
| 3,545,062 | 12/1970 | Cox | 165/166 |
| 3,918,430 | 11/1975 | Stout et al. | 165/170 |

*Primary Examiner*—Carroll B. Dority, Jr.
*Assistant Examiner*—Theophil W. Streule, Jr.
*Attorney, Agent, or Firm*—Martin G. Raskin

[57] ABSTRACT

A heat exchanger for transmitting thermal energy from one moving fluid to another of the type having a casing housing a thermal transfer core, the core including a folded sheet of heat conductive material defining adjacent fluid flow passages, the individual fold sections of the sheet having a multiplicity of pairs of dimples formed therein, each dimple pair including a raised dimple and an adjacent depressed dimple, the height of each dimple being substantially equal to one-half the width of the fluid flow passages. The dimple arrangement provides a relatively low pressure drop for the fluids passing through the fluid flow passages.

7 Claims, 7 Drawing Figures

44d'
44
35d
44cd
35c
46
44bc
48
38
48
46
48
40
38
35b
42
48b
40
44ab
48a
38
40
42
35a
44
44a'
48'
58
48
42
36
54
50
52
40
26
35
60
52
50
48'
58
54
40
26
60
52
42
36
42
54
48'
54
48
42

THERMAL TRANSFER CARE

BACKGROUND OF THE INVENTION

This invention relates in general to heat exchangers and more particularly to a heat exchanger for transmitting thermal energy from one moving fluid to another having an improved core structure capable of accommodating maximum fluid flow with minimum pressure drop. p In general, heat exchangers wherein thermal energy is transferred from a higher temperature gaseous medium to a lower temperature gaseous medium are well known. More particularly, heat exchangers comprising a generally rectangular casing which houses a thermal transfer core, which core includes a sheet of heat conductive material folded upon itself dividing the interior of the casing into adjacent fluid flow passages, alternate ones of the passages defining a first conduit for conducting a first gaseous medium with the other passages defining a second conduit for conducting a second gaseous medium, are known. Such heat exchangers are generally illustrated in, for example, U.S. Pat. Nos. 2,576,213 to Chausson and 2,945,680 to Slemmons. These devices are useful as heat recovery or air conditioning apparatus for buildings, for passenger compartments of vehicles, or, in general, wherever the recovery of thermal energy otherwise wasted, would be beneficial.

The presently known heat exchangers of the type discussed hereinabove, however, are subject to several disadvantages due in the main to the particular structure of the heat exchanger core. Since the fluid flow passages are defined by the spaces between adjacent folds of a folded sheet of heat conductive material and since alternate, adjacent fluid flow passages serve to conduct first and second gaseous mediums which are generally at different pressures, a pressure differential exists over the relatively long flexible sheet which separates adjacent flow passages. This can cause flexion of the sheet towards the lower pressure area which will narrow or lessen the width of that passage thereby impeding the flow of the gaseous medium. Similarly, the high pressure fluid flow passages will be widened thereby upsetting the calculated flow through those passages. In order to overcome this disadvantage it has been proposed to provide spacers between adjacent folds of the heat conductive sheet. These spacers are employed to maintain the spacing between the adjacent folds. For example, it has been suggested to form dimples in the alternate folds of the heat transfer sheet having a height equal to the desired clearance between adjacent folds which define the low pressure fluid flow passages to prevent this collapse due to the pressure differential. Further, it has been suggested to provide more widely spaced projections having a height equal to the desired clearance between adjacent folds defining the high pressure fluid flow passages to maintain the desired clearance in these passages.

This proposed structure has not, however, proved entirely satisfactory. It has been found that to effectively prevent collapse of the low pressure fluid passages according to the previously proposed techniques, a large number of dimples extending into these passages were necessary. These dimples, however, obstructed the efficient flow of the gaseous medium through the fluid flow passages giving rise to losses which rendered the system too inefficient for practical use. Further, where large projections were employed in the high pressure fluid flow passages, they also were found to intermittently block the flow of the fluid forcing it to flow in a direction transverse to the desired direction of flow thereby causing similar losses.

Furthermore, it has frequently been found that it is desirable to have relatively wide spacing between the adjacent folds of the heat exchanger sheet. The more desirable heat conductive materials from which the core is constructed, however, are limited, due to the desirability of having a very thin sheet material separating adjacent fluid flow passages and due to the characteristics of the material itself, in the depth to which these spacer dimples can be drawn.

SUMMARY OF THE INVENTION

Accordingly, one object of the present invention is to provide a new and improved heat exchanger for transmitting thermal energy from one moving body of fluid to another;

Another object of the present invention is to provide a heat exchanger of the type described having a new and improved core structure.

Still another object of the present invention is to provide a new and improved core structure for a heat exchanger of the type described wherein the fluid flow passages defined by the core have improved structural integrity.

A further object of the present invention is to provide a heat exchanger of the type described having improved flow characteristics.

A still further object of the present invention is to provide a more efficient heat exchanger of the type described having structure which permits ease and economy in fabrication.

According to the present invention, these and other objects are obtained by providing a heat exchanger comprising a casing and a thermal transfer core therewithin, formed of a sheet of heat conductive material folded upon itself which divides the interior of the casing into adjacent fluid flow passages. The folded sections of the sheet which define the walls of the fluid flow passages have a multiplicity of pairs of dimples formed therein. Each pair of dimples include a raised dimple and an adjacent depressed dimple, the height of each dimple being substantially equal to one-half the width of the fluid flow passages. In a preferred embodiment of the invention, adjacent fold sections of the heat transfer sheet have patterns of dimples which are substantially mirror images of each other so that upon folding the sheet to bring the adjacent fold sections into confronting relationship, the raised and depressed dimples of each fold section abut the corresponding raised and depressed dimples of the adjacent fold section.

DESCRIPTION OF THE DRAWINGS

The above invention will be better understood with reference to the following detailed description of the invention in conjunction with the drawings in which.

DETAILED DESCRIPTION OF THE PREFERRED EMBODIMENT

Figure 1:
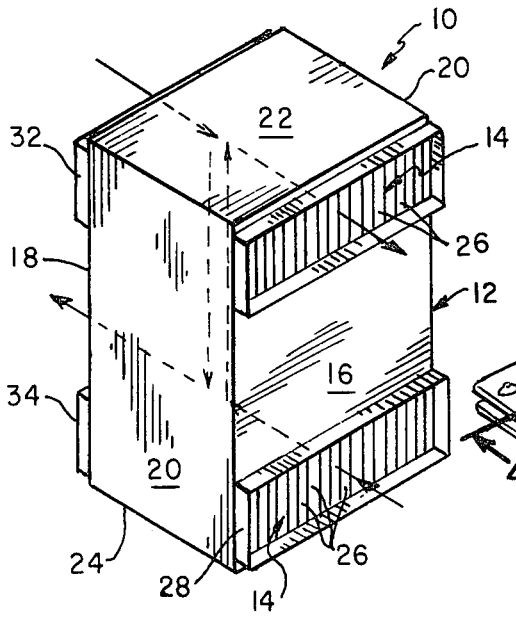
FIG. 1 is a perspective view of a heat exchanger having a core structure according to the present invention.

Referring now to the drawings where like reference numerals refer to corresponding or identical parts throughout the several views and more particularly to FIG. 1, a heat exchanger, generally denoted as 10, is illustrated as comprising a generally rectangular casing 12 and a thermal transfer core 14 housed within the casing 12. Casing 12 comprises first and second opposed sides 16, 18 respectively, lateral opposed sides 20 and top and bottom sides 22, 24 respectively.

Thermal transfer core 14 comprises a sheet of heat conductive material, such for example as aluminum, which is folded or pleated upon itself, the fold section extending longitudinally through the casing and dividing the interior of the casing into adjacent fluid flow passages, alternate ones of the passages 26 defining a first conduit means for conducting relatively warm fluids, the other passages 36 (not seen in FIG. 1) defining a second conduit means for conducting relatively cool fluids.

Entrance and exit openings 28, 30 respectively are provided in first opposed side 16 for the first conduit means while entrance and exit openings 32, 34 are provided in second opposed side 18 for the second conduit means. It will be understood that a relatively warm gas, such as stale air which accumulates within a building enters the first fluid passages 26 through entrance opening 28 and exits therefrom through exit opening 30. At the same time, a relatively cool gas such as fresh air from outside the building, enters the second fluid passages through entrance opening 32 and flows in opposed direction to the warm gas, exiting from the heat exchanger through exit opening 34. Thermal energy is transferred through the fold sections of thermal transfer core 14 from the warmer gas to the cooler gas.

The present invention relates to the particular structure of thermal transfer core 14. As explained above, the pressure differential which exists between adjacent fluid flow passages has frequently in the past resulted in the low pressure fluid flow passages collapsing. When spacers in the form of dimples were drawn from the sheet material of the core in an attempt to alleviate the problem it was found that when sufficient dimples were provided to prevent collapse, the flow of fluid through the passages was severely impeded by the dimples resulting in serious energy losses and large undesirable pressure drops. Further, the material and desired dimensions of the core often prevented dimples, which heretofore were of a height equal to the desired width of the fluid flow passages, from being drawn from the heat transfer sheet. The present invention provides a thermal transfer core having a capability of withstanding relatively high pressure differentials without collapse and wherein the flow of the fluid medium is not materially obstructed in any of the fluid flow passages. Further, the particular core structure of the present invention is easy and economical to manufacture and is versatile with respect to the final dimensional configuration of the folded core.

Figure 2:
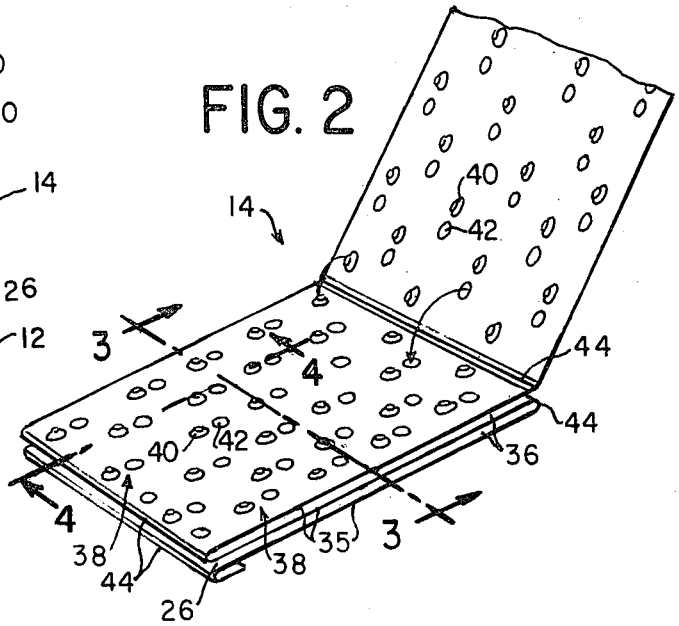
FIG. 2 is a perspective view of a portion of a thermal transfer core according to the present invention partially unfolded for use in the heat exchanger shown in FIG. 1.
Figure 3:
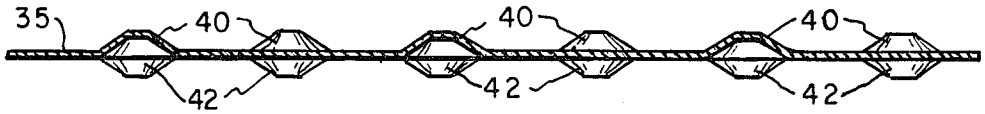
FIG. 3 is a section view taken along line 3—3 of FIG. 2 of a single fold section of a thermal transfer core according to the present invention.
Figure 3A:
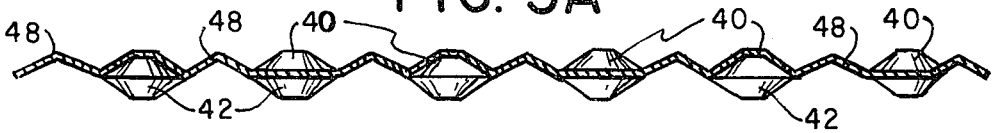
FIG. 3A is a section view of a modification of the single fold section of the thermal transfer core shown in FIG. 3 according to the present invention.
Figure 4:
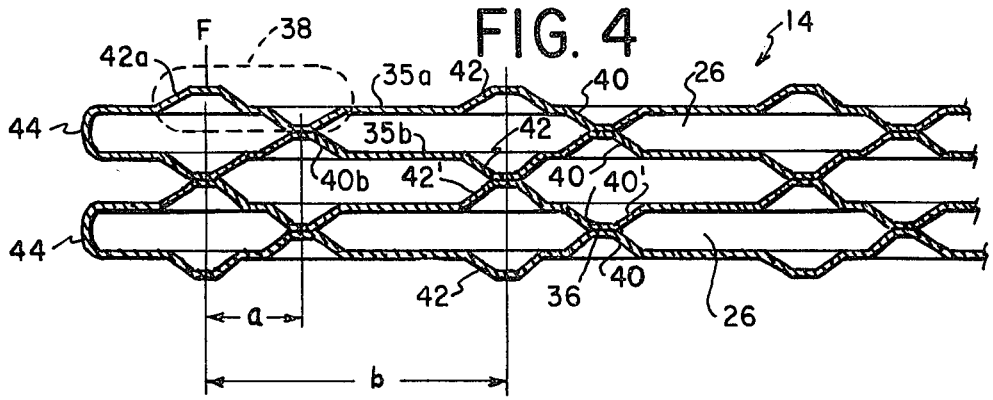
FIG. 4 is a section view taken along line 4—4 of FIG. 2 of a thermal transfer core according to the present invention.

Referring to FIGS. 2–5, a thermal transfer core 14 and modifications thereof (or portions thereof) according to the present invention are shown. The thermal transfer core 14 is preferably constructed from a thin sheet of heat conductive material, such, for example, as aluminum having a thickness of 0.01 inch. The sheet is folded upon itself along fold lines 44 as shown in FIGS. 2 and 4 forming fold sections 35 which define between them adjacent fluid flow passages 26 (shown in FIG. 1) and 36 (FIGS. 1, 2 and 4) alternate ones of the passages 26, for example, defining a first conduit for conducting relatively warm fluids while the other passages 36 define a second conduit for conducting relatively cool fluids.

Each fold section 35 has a multiplicity of pairs 38 of dimples formed in it, each dimple pair including a raised dimple 40, i.e., a dimple which extends above the plane of the fold section 35 and, in close proximity, a depressed dimple 42, i.e., a dimple which extends below the plane of the fold section 35. Preferably, the dimples have a truncated conical configuration but may be of any other desired configuration within the present invention. It should be noted that when reference is made to a "raised" or "depressed" dimple, this characterization is made prior to folding the heat transfer sheet. Accordingly, after folding the sheet into the core configuration, (see FIG. 4), even though a dimple may appear depressed (for example, dimple 40') or raised (dimple 42') it will be understood that this is merely the configuration obtained after folding and it is in the prefolding configuration that the characterizations raised and depressed are assigned. The spacing *a* (FIG. 4) between raised and depressed dimples 40, 42 respectively in a dimple pair 38 is small relative to the spacing *b* between adjacent dimple pairs for reasons explained in detail hereinbelow. For example, according to the present invention, for a 3000 c.f.m. unit, *a* may be 0.5 in and *b* may be 2 in. Each dimple 40, 42 is drawn to a height of approximately one-half the desired spacing between adjacent fold sections which, of course, is the desired width of the fluid flow passages 26, 36. For example, for a 3000 c.f.m. unit, the width of the fluid flow passages are desirably 0.2 so that the height of dimples 40, 42 is approximately 0.1 in.

Figures 5, 6:
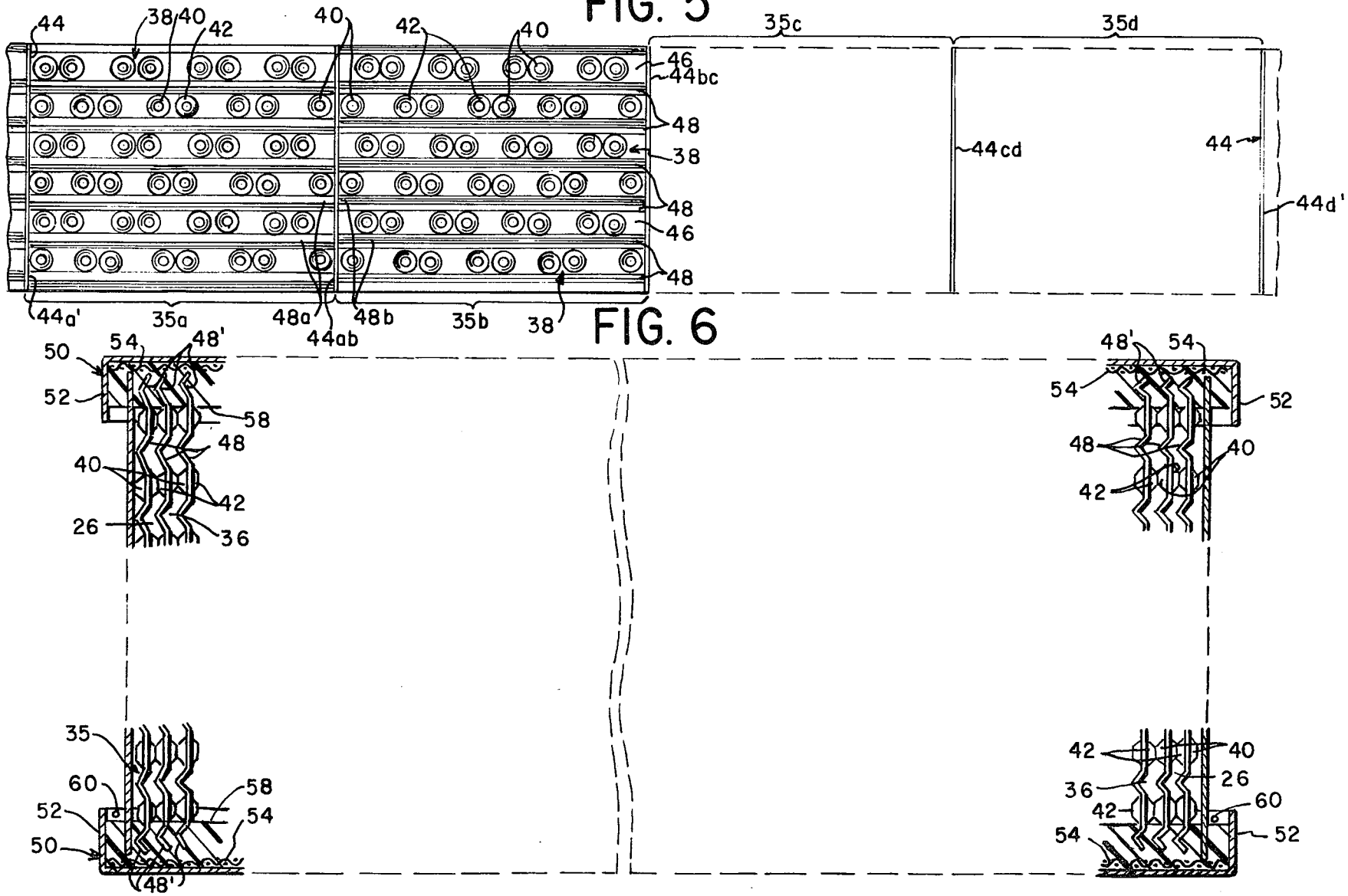
FIG. 5 is a plan view of several fold sections of an unfolded thermal transfer core according to the present invention.
FIG. 6 is a section view of a heat exchanger having a thermal transfer core according to the present invention.

As mentioned hereinabove, the thermal transfer sheet is folded upon itseld along fold lines 44 to define a plurality of pairs of mutually opposed fold sections 35. Of course, the mutually opposed fold sections were those sections adjacent to each other prior to the heat transfer sheet being folded (as best seen in FIG. 5). According to the present invention, the arrangement of dimple pairs 38 of one fold section is substantially a mirror image of the dimple pair arrangement of the adjacent fold section relative to the intermediate fold line. For example, referring to FIG. 5, the dimple arrangement of fold section **35*b* is substantially a mirror image of the dimple arrangement of fold section 35*a* relative to fold line 44*ab*. Similarly, the dimple arrangement (not shown) of fold section 35*c* is substantially a mirror image of fold section 35*b* relative to fold line 44*bc* while the dimple arrangement (not shown) of fold section 35*d* is substantially a mirror image of fold section 35*c* relative to fold line 44*cd*. Thus as best seen in FIG. 4, upon folding the thermal transfer sheet along fold lines 44, the raised dimples 40 in one fold section 35 will abut corresponding raised dimples 40 (which now extend downwardly) in the next upper adjacent opposed fold section while the depressed dimples 42 in that fold section 35 will abut corresponding depressed dimples 42** (which now extend upwardly) in the next lower adjacent opposed fold section. Since each dimple has a height substantially equal to one-half the desired spacing between adjacent fold sections, the resulting spacing between the fold sections results is that desired.

Referring to FIG. 5, in the preferred embodiment of the invention, each fold section 35 is divided into several longitudinally extending zones 46. Although six such zones 46 are shown, it is understood that more or less may be so provided within the scope of the present invention. Each zone 46 contains a plurality of dimple pairs 38, the individual dimples 40, 42 being disposed in a longitudinal relationship within the zone. This structure is advantageous in that ridges or channels 48 (FIGS. 3 and 5) may be formed in the heat transfer sheet intermediate each zone 46 which extend longitudinally along the entire length of each fold section. These ridges serve to stiffen each fold section and, accordingly the entire assembly, in order to prevent bending or collapse of the same during operation. Each ridge comprises a pair of sides which taper towards each other and meet at an apex.

The height of each rib is preferably less than the height of the dimples. Further, referring to FIG. 5, whereas the ridges in fold section 35*a* include sides which taper in an upward direction, the corresponding ridges in fold sections 35*b* taper in a downward direction so that upon folding the heat transfer sheet, the corresponding ridges tend to nest within each other thereby obviating the possibility of opposed ridges interfering with each other in the folded heat transfer core. Since the heat transfer sheet is folded in opposite directions on adjacent fold lines, it will be understood that longitudinally adjacent ridges in corresponding zones in adjacent fold sections throughout the heat transfer sheet will taper in opposite directions so that these ridges will nest as described above.

The structure of the thermal transfer core 14 according to the present invention as described above results in heat exchangers having unexpectedly low pressure drops and surprisingly good structural rigidity. Referring to FIG. 4, a force denoted F, present on a dimple 42*a* on fold section 35*a* due to a pressure differential between adjacent fluid flow passages, has a minimal distance *a* to traverse to be transmitted to dimple 40*b* on the next adjacent fold section 35*b* via dimple 40*a*. This minimal distance *a* which a force must traverse before encountering the stiffening effect of the next adjacent dimple is desirable in heat exchangers where a low pressure drop through the exchanger is desired since an excessive number of dimples (which would occur where distance *b* was small) will increase the pressure required to force through a given flow of fluid.

Another advantage of the structure of the invention wherein the adjacent raised and depressed dimples formed in each fold section abut the corresponding raised and depressed dimples of the adjacent fold section, each dimple having a height of one-half the desired spacing between the fold sections vis-a-vis structures wherein dimples having a height equal to the desired spacing between fold sections directly abut against the adjacent fold section is that in the prior art instance, these large dimples intermittently block the flow of fluid and force it to flow in a transverse direction around the dimple. In the structure of the present invention, upon the fluid encountering a dimple in a fluid flow passage, it is drawn into the void defined by the adjacent dimple formed in the same fold section. This minimizes the flow disturbance in the fluid flow passages and, therefore, the pressure drop.

Another benefit derived from the above-described structure and, in particular, the feature wherein adjacent fold sections have patterns of dimples formed therein which are substantially mirror images of each other with respect to the intermediate fold line, is that in addition to reverse folding the thermal transfer core along each adjacent fold line, the core of the present invention, if so desired, is capable of being reverse folded along alternate fold lines resulting to fluid flow passages which are twice as deep as are obtained in the former case. For example, referring to FIG. 5, rather than reverse folding the heat transfer sheet along adjacent fold lines 44*a'*, 44*ab*, 44*bc*, 44*cd* and 44*d'* resulting in fluid flow passages having a depth equal to the length of a single fold section, the sheet according to the present invention may be reverse folded alternate fold lines, eg. 44*a'*, 44*bc*, 44*d'* resulting in fluid flow passages having a depth equal to the length of two fold sections. It is noted that the unique dimple pattern of the present invention provides that corresponding raised and depressed dimples will abut each other to define the fluid flow passages whether the thermal transfer sheet is folded along adjacent (primary) fold lines or along alternate (secondary) fold lines.

Further, by providing that adjacent fold sections, such for example as fold section 35*a* and 35*b* in FIG. 5, are mirror images of each other, yet another important advantage is obtained, namely, that the dimple patterns in alternate pairs of fold sections, eg. fold sections 35*a*, 35*b*, 35*c*, 35*d* are identical. This greatly facilitates manufacture in that only one die is necessary for the fabrication of the thermal transfer sheet. Alternatively, one die having a pattern of a single fold section may be utilized if it is physically reversed in space during the stamping of the thermal transfer sheet.

The manufacture of the thermal transfer core is greatly facilitated by the provision of ridges 48. Referring to FIG. 5, it is seen that the adjacent terminal ends of the ridges 48 formed in adjacent sections define the fold lines on which the thermal transfer sheet is folded. For example, the opposing terminal ends 48*a*, 48*b* of ridges 48 formed on fold sections 35, 35*b* respectively, define fold line 44*ab*. The lack of stiffening along fold line 44*ab* greatly facilitates folding the heat transfer sheet along this line.

Turning now to FIG. 6, an arrangement for sealing the ends of the fluid flow passages 26, 36 against cross-leakage is shown. Top and bottom members 50, of the heat exchanger are formed having substantially a cup shape with rims 52. The edges of each fold section 35 comprise ridges 48. Just prior to assembly, the bottom member is filled with an epoxy cement or other quick curing agent, preferably to a height slightly less than the height of rim 52. The edges of the folded thermal transfer core are then positioned within the bottom member and the epoxy allowed to cure. Preferably a wire reinforcing mesh 54 is disposed within bottom member 50 prior to the introduction of the epoxy. The side members 56 are placed in position with their terminal edges immersed in the epoxy. When the epoxy cures a surprisingly strong structure results due to ridges 48' which acts as anchors within the epoxy. The assembly is then turned over and the top member applied in the same manner.

A further advantage of this arrangement is that since the level of the epoxy is somewhat below the upper edge of rim 52, a convenient trough 58 is formed in bottom member 50 for any water which may condense in the fluid flow passages. A drain port 60 may be provided to allow the condensate to be withdrawn from the trough.

As can readily be seen, many modifications in the above-described heat exchanger are possible within the scope of the present invention. Accordingly, this invention is defined only by the appended claims and equivalents thereof.

I claim:

1. A heat exchanger for transmitting thermal energy from one moving body of fluid to another comprising a casing of substantially constant cross-sectional area and a thermal transfer core within said casing, said core including a single, integrally formed, substantially continuous sheet of heat conductive material having a plurality of fold sections, separated by fold lines, the individual fold sections of said sheet dividing the interior of said casing into adjacent fluid flow passages, alternate ones of said passage defining first conduit means for conducting relatively warm fluids, the other passages defining second conduit means for conducting relatively cool fluids, said casing having first and second pairs of inlet and outlet openings formed therein, said first and second pairs of openings communicating with said first and second conduit means respectively, the individual fold sections of said sheet having a multiplicity of pairs of dimples formed therein, said dimple pairs being aligned longitudinally with respect to each other in at least two longitudinally extending zones, each said pair of dimples comprising a raised dimple and an adjacent depressed dimple wherein the spacing between the raised and depressed dimple in each dimple pair is small with respect to the spacing between adjacent, longitudinally aligned pairs of dimples, the height of each dimple being substantially equal to one-half the width of said fluid flow passages, the individual fold sections of said sheet each having longitudinally extending ridges formed therein, each ridge being formed between zones of aligned dimple pairs of extending over the substantial length of said fold section and each ridge terminating before the next adjacent fold section, the terminal ends of said ridges in each fold section defining a fold line between the adjacent fold sections, said dimple pairs being located in said fold sections so that upon folding said sheet of heat conductive material upon said fold lines in opposite directions alternately, raised and depressed dimples in each dimple pair are in opposed, abutting relationship with corresponding raised and depressed dimples in adjacent fold sections, whereby said opposed, abutting dimples provide spacing between and mutual support for adjacent fold sections, said spacing between adjacent fold sections defining said fluid flow passages in a manner such that the fluid pressure drop through the heat exchanger is reduced.

2. A heat exchanger as recited in claim 1 wherein adjacent fold sections have patterns of dimles formed therein which are substantially mirror images of each other with respect to one intermediate fold line so that upon folding said sheet along said fold line to bring the adjacent fold sections into confronting relationship, the raised and depressed dimples of each fold section abut corresponding raised and depressed dimples respectively of the adjacent fold sections.

3. A heat exchanger as recited in claim 2 wherein said longitudinally extending ridges formed in alternate fold section comprise raised channels and said ridges formed in the other fold sections comprise depressed channels, each such raised channel in a fold section being colinearly formed with a corresponding channel in the adjacent fold section so that upon folding said sheet along said fold line to bring the adjacent sections into confronting relationship, corresponding ridges in adjacent fold sections nest within each other.

4. A heat exchanger as recited in claim 1 wherein alternate fold sections have patterns of dimples formed therein which are substantially identical to each other so that upon folding said sheet along alternate fold lines the dimples of a pair of adjacent fold section abut corresponding dimples of the adjacent pair of adjacent fold sections.

5. A heat exchanger as recited in claim 1 wherein ridges are defined in the upper and lower edges of each fold section, and casing including top and bottom members, each member being substantially cup-shaped and said upper and lower edges of said fold section being located within the respective top and bottom members, and a cured cement being disposed within top and bottom members encapsulating said ridges thereby fastening said fold sections in place.

6. A heat exchanger as recited in claim 5 wherein said bottom cup-shaped member includes a rim circumferentially extending therearound having a free edge extending beyond the upper surface of the resin defining a trough for condensate forming in said heat exchanger.

7. A heat exchanger as recited in claim 6 wherein a drain port is provided in the portion of said rim which extends above the upper surface of the resin to drain the condensate which may accumulate in the trough.

* * * * *

UNITED STATES PATENT AND TRADEMARK OFFICE

CERTIFICATE OF CORRECTION

PATENT NO. : 4,043,388

DATED : August 23, 1977

INVENTOR(S) : William Henry Zebuhr

It is certified that error appears in the above-identified patent and that said Letters Patent are hereby corrected as shown below:

In the title, change "CARE" to -- CORE --

Col. 1, line 10, delete "p"

Col. 3, line 27, change "section" to -- sections --

Col. 4, line 51, change "itseld" to -- itself --

Col. 6, line 17, change "to" to -- in --

Col. 6, line 47, after "adjacent" insert -- fold --

Col. 7, line 47, before "extending" change "of" to -- and --

Col. 8, line 10, change "dimles" to -- dimples --

Col. 8, line 12, change "one" to -- the --

Col. 8, line 20, change "section" to -- sections --

Col. 8, line 37, before "casing" change "and" to -- said --

UNITED STATES PATENT OFFICE

CERTIFICATE OF CORRECTION

Patent No. 4,043,388 Dated August 23, 1977

Inventor(s) William Henry Zebuhr

It is certified that error appears in the above-identified patent and that said Letters Patent are hereby corrected as shown below:

Col. 8, line 39, change "section" to -- sections --.

Signed and Sealed this

*Twenty-fourth* Day of *January 1978*

[SEAL]

*Attest:*

RUTH C. MASON
*Attesting Officer*

LUTRELLE F. PARKER
*Acting Commissioner of Patents and Trademarks*